US007302773B2

(12) United States Patent
Rozhkov et al.

(10) Patent No.: US 7,302,773 B2
(45) Date of Patent: Dec. 4, 2007

(54) METHOD OF FIRING OF FIREARMS

(76) Inventors: Leonid Rozhkov, 801 Locust Pl. NE., Apt. 1223, Albuquerque, NM (US) 87102; Igor Rozhkov, 45 Knyaz Ostrozhsky Street, Apt. 72, Ternopil (UA) 46001

( * ) Notice: Subject to any disclaimer, the term of this patent is extended or adjusted under 35 U.S.C. 154(b) by 0 days.

(21) Appl. No.: 11/001,450

(22) Filed: Nov. 30, 2004

(65) Prior Publication Data

US 2007/0251133 A1 Nov. 1, 2007

Related U.S. Application Data

(60) Provisional application No. 60/526,634, filed on Dec. 3, 2003.

(51) Int. Cl.
*F41A 3/00* (2006.01)

(52) U.S. Cl. ..... 42/2; 42/25; 89/1.701; 89/1.706

(58) Field of Classification Search ..... 42/68, 42/25, 2; 89/194, 196, 1.7, 1.701, 1.704, 89/1.705, 1.706
See application file for complete search history.

(56) References Cited

U.S. PATENT DOCUMENTS 797,420 A 8/1905 Febiger
1,343,444 A 6/1920 Formby
1,373,966 A 7/1921 Oliver
2,027,892 A 1/1936 Williams
2,090,656 A 8/1937 Williams
2,090,657 A 8/1937 Williams
2,336,146 A 12/1943 Willams
2,356,491 A 8/1944 Loomis
2,516,926 A 8/1950 Simpson
2,847,787 A 9/1958 Williams
2,920,537 A 1/1960 Simmons
3,547,001 A 12/1970 Stoner
4,541,193 A * 9/1985 Flippin ..... 42/68
5,309,815 A * 5/1994 Moller et al. ..... 89/163
2003/0056639 A1* 3/2003 Giza ..... 89/1.701

OTHER PUBLICATIONS

Igor Chechailyuk, Non-standard designs of automatic firearms, Firearms and Hunting, A specialized firearms magazine, p. 8-10, 12(17) 2000, Ukraine Press, Kiev, Ukraine.

* cited by examiner

*Primary Examiner*—Michael J. Carone
*Assistant Examiner*—Gabriel J. Klein
(74) *Attorney, Agent, or Firm*—Alfred J. Mangels

(57) ABSTRACT

A method of firing of arms which utilizes both action and reaction forces in the process of firing. The action force propels the projectile (14) while the opposite in direction reaction force is used with an independent freely moving inert mass (20) in which a cartridge case (18) resides. Since the movement of the inert mass (20) does not affect the position of the barrel (12) prior to the projectile (14) leaving the muzzle, the barrel (12) remains steady during firing, thus achieving very high accuracy of shooting.

29 Claims, 3 Drawing Sheets

28
20
18
16
14
30
12
10
22

28
18
24
20
30
12
10

18
26
24
20
30
12
22

METHOD OF FIRING OF FIREARMS

CROSS-REFERENCE TO RELATED APPLICATIONS

This application claims the benefit of the filing of U.S. Provisional Patent Application Ser. No. 60/526,634, filed by these inventors on Dec. 3, 2003, and the specification thereof is incorporated herein by reference.

GOVERNMENT RIGHTS

Not applicable.

BACKGROUND OF THE INVENTION

1. Field of the Invention (Technical Field)

The present invention relates generally to cannons and firearms, more particularly to a method of firing projectiles there from. This invention is applicable to all types of arms.

2. Background Art

Firearms are known to have appeared in Europe in the fourteenth century. The usage of propellant charge energy to propel projectiles has begun a new era in the military. This led to the introduction of artillery and, right after that, small arms. These early types of arms comprised an iron or bronze tube (i.e. a barrel) with two ends, one of which was tightly closed. Loading of such firearms was done by placing a certain amount of propellant (gunpowder) into the barrel bore close to the closed end and then introducing a projectile into the barrel. Firing of the propellant was done by igniting it via a small opening in the barrel at the closed end. With minor improvements, this method of firing of firearms was used till the nineteenth century when a unitary cartridge was invented.

The invention of the cartridge initiated the development of magazine firearms and, right after that, automatic firearms. Even though the creation of automatic firearms provided a solution to the problem of rapid firing, such basic qualitative characteristics of firearms as precision and small projectile dispersion still have not gained any significant improvement. The best types of automatic firearms at the beginning of the twenty-first century are inferior in these characteristics to ordinary rifles at the end of the nineteenth century. This is due to the fact that the method of firing of automatic firearms still has its inherent flaws: at the beginning of projectile movement in the barrel bore during firing of a cartridge, the firearm (i.e. the barrel, breech bolt, frame, etc.) gets displaced. The inconsistency in the angles of departure (i.e. the angles at which projectiles leave the muzzle) from shot to shot causes their dispersion. The greater the projectile energy or impulse, the greater the dispersion.

The problem of significant projectile dispersion can partially be solved by increasing the firearm weight, which is almost never desirable. An alternative approach to reducing the dispersion is to decrease the distance between the barrel centerline and the center of mass of the firearm, or between the center of mass of the firearm and that of the operator. This reduces the moment arm of the force that appears upon firing (commonly referred to as the recoil force). However, such reduction of the moment arm adversely affects other important qualities of the firearm, such as its stability before firing, unsatisfactory placement of mechanisms, poor design, etc. In modern firearms, the magnitude of the force that influences the firearm displacement before the projectile has left the muzzle is reduced by extending this force in time. This approach only partially solves the problem since the displacement of the firearm prior to the projectile leaving the muzzle is still inherent to such firearm designs.

An important weakness of most existing types of arms is the fact that they are engineered by the basic principles set forth centuries ago regarded as immutable. The presence of a breech locking mechanism not only presents serious limitations on the achievable accuracy, but also makes the arm significantly complicated in construction which adversely affects its reliability, and results in high manufacturing costs.

Against the foregoing background, the present invention was developed.

SUMMARY OF THE INVENTION (DISCLOSURE OF THE INVENTION)

The present invention provides a conceptually new method of firing of firearms, which overcomes the objections mentioned above. This disclosure will often refer to "firearms", but it is to be understood that the invention has utility in arms of all types, not just small arms to be carried on the person, but including cannon and other heavy arms. The term "firearm" is to be understood as an assembly that comprises a barrel from which a projectile is propelled through a deflagration of propellant. Thus it is intended to include any type of arms to which the above definition is applicable. The superiority of the firearms built according to this invention can be best represented by the following features. Because of a negligible angular barrel displacement during firing compared to that of all existing arms, the inventive firearms apparatus has very high accuracy. The simplicity of firearm construction naturally results in their high reliability, inexpensiveness, simple technological requirements to manufacture, excellent weight distribution, and the ability to build firearms with very high firing rates. This invention also permits the usage of high power ammunition with the above mentioned advantageous features unaffected. This all makes such firearms excellent weaponry for the armed forces, law enforcement, and other professional services.

The invention features a new approach in firearm design that results in better characteristics compared to all existing types of firearms. Accordingly, several objects and advantages of the present invention are:

1. Small projectile dispersion;
2. Excellent accuracy of firing;
3. Simple firearm construction;
4. Inexpensive to manufacture;
5. Technologically simple to manufacture;
6. The ability to use high power ammunition with other firearm qualities not being adversely affected;
7. High reliability;
8. High degree of safety;
9. The ability to build light-weight firearms;
10. Compactness of firearm construction;
11. Excellent mass distribution;
12. The ability to create firearms with high firing rates;
13. The ability to manufacture such firearms using simple machine tools;
14. The ability to use low-qualified work force in the process of firearm manufacture;
15. The barrel of such firearms is protected from any external mechanical damage such as shell or bomb splinters, tank dynamic defense systems, as well as any meteorological conditions (temperature, rainfall, snowfall, wind, etc.);

16. Little amount of time necessary in the manufacturing cycle;
17. Excellent reparability;
18. Excellent interchangeability of firearm parts;
19. Simple maintenance;
20. The possibility to create new firearm designs derived from the present invention;
21. The ability to develop derived firearm designs that fire with subsonic projectile velocity using some standard ammunition which otherwise has over-sonic projectile velocity. This feature is important when there is a need for reducing the noise of discharge with a silencer;
22. The firearms and all weaponry that function-according to the method of firing of the present invention will be highly competitive on the market of arms and weaponry.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

REFERENCE NUMERALS IN DRAWINGS

| | | | |
|---|---|---|---|
| 10 | Frame | 12 | Barrel |
| 14 | Projectile | 16 | Propellant |
| 18 | Cartridge case | 20 | Inert mass |
| 22 | Muzzle end | 24 | Breech end |
| 26 | Hollow bore | 28 | Stop |
| 30 | Barrel bore | | |

DESCRIPTION OF THE PREFERRED EMBODIMENTS

Best Modes for Carrying Out the Invention

FIGS. 1, 2, 3, and 6—Preferred Embodiment

Figures 1, 2, 3:
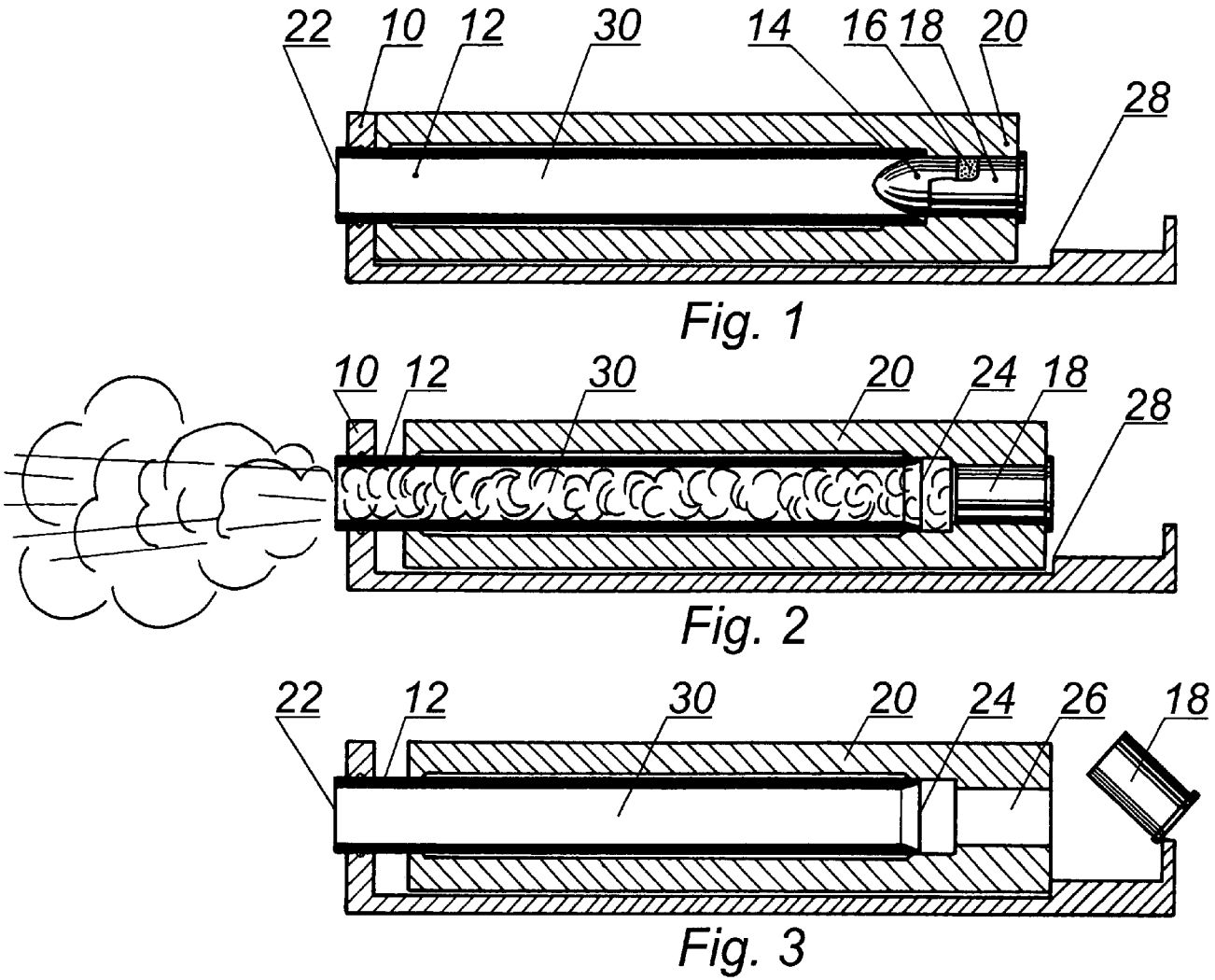
FIG. 1 is a schematic drawing of a partial side view shown in section of a firearm constructed according to the present invention. The schematic shows the arrangement of parts of an apparatus according to the present invention before the firing of a cartridge.
FIG. 2 is a schematic drawing similar to FIG. 1, showing the arrangement of parts after the projectile has exited the muzzle, but before gas pressure in the barrel bore has dropped to a level safe for cartridge case extraction.
FIG. 3 is a schematic drawing similar to FIG. 2, showing the arrangement of parts of an apparatus according to the invention, after the projectile has left the muzzle and gas pressure in the barrel bore has dropped to a level safe for cartridge case extraction.

FIG. 1 shows a schematic conceptual view of a part of a weapon apparatus constructed according to the present invention. The firearm is loaded with a cartridge and is ready to fire. The cartridge comprises a projectile 14, propellant 16, and a cartridge case 18. The part of the firearm shown in FIG. 1 comprises the following elements: a frame or base 10, a barrel 12, and an inert mass 20. Frame 10 is an element or a set of combined elements that it used to mount and support some or all parts and mechanisms of the firearm.

Barrel 12 is mounted in frame 10. Barrel 12 can either be immovably affixed to frame 10 or be movable in frame 10 along the barrel's longitudinal axis, depending on a specific firearm design. Also, barrel 12 can be made replaceable in firearms with high firing rates, such as in various types of machine guns. This option would allow a quick replacement of a hot barrel with a new cold one and immediately resume firing thus eliminating the possibility of inaccurate firing due to the temperature expansion of the barrel. In the specific implementation shown in FIGS. 1-3, barrel 12 is immovably affixed to frame 10. Barrel 12 has a bore for the passage of projectile 14 in a specific direction and with a predetermined velocity. The outer part of barrel 12 serves as a guide-rod for inert mass 20.

Inert mass 20 is disposed on barrel 12 for a reciprocating motion along the barrel's longitudinal axis. When the firearm is in battery position, inert mass 20 is situated close to the frontal wall of frame 10, as seen in FIG. 1. When ammunition is fired, the range of backward movement of inert mass 20 is limited by stop 28, as seen in FIG. 3. Inert mass 20 is an element or a set of elements of a firearm which is acted upon, at least partially, by the reaction force opposite to the force that moves projectile 14 in the barrel bore during firing of a cartridge. Inert mass 20 possesses the property of additiveness, i.e. it can consist of several separate members, in which case the total weight of inert mass 20 will be the arithmetic sum of the respective weights of all its members. Inert mass 20 is made of such total weight as to provide enough time necessary for the projectile to leave the muzzle before inert mass 20 hits stop 28 in the process of firing ammunition. The specific weight and form of inert mass 20 is chosen according to the particular type of firearm where it is to be used.

In this description, references are made to different states of a firearm. A firearm is said to be in battery position when it is loaded and ready for firing. In the process of firing, it is important to point out that after projectile 14 has left the muzzle, gas pressure in the barrel bore and inert mass 20 still remains high for some short period of time. This gas pressure drops rapidly to reach the equilibrium with the ambient gas pressure. It is understood that it is safe to perform cartridge case extraction when the pressure in the barrel bore and inert mass 20 has dropped to a level approximately equal to the level of the ambient gas pressure.

Projectile 14 is an object propelled from barrel 12 of a firearm during firing, and is used for target hitting, target pointing, etc. Projectile 14 can be disposed in inert mass 20, in barrel 12, or between them. Cartridge case 18 is a part of a cartridge which serves as a complete or partial gas seal during firing of the cartridge. It is disposed in inert mass 20 before and during firing.

Figure 6:
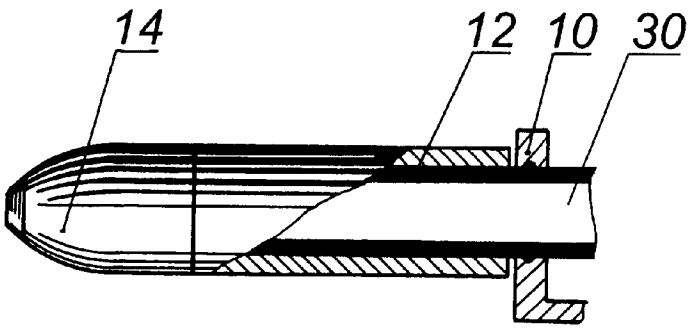
FIG. 6 is a partial view of a firearm according to the present invention, depicting that the invention may be adapted for use with an over-caliber projectile.

For over-caliber projectiles (i.e. projectiles whose caliber is bigger than the caliber of the barrel), the outer surface of barrel 12 can be used as a guide for the movement of projectile 14. As shown in FIG. 6, barrel 12 extends sufficiently beyond the frontal part of frame 10 of the firearm, so that over-caliber projectile 14 can be situated on the frontal end of barrel 12. FIG. 6 demonstrates one of many possible designs for a firearm that operates with over-caliber projectiles.

An apparatus according to the invention thus is a firearm and ammunition combination. The firearm features the barrel 12 that has an open breech end 24 and a muzzle end 22, and the "inert" mass 20 moveable in relation to the barrel 12, the mass 20 defining the hollow bore 26 substantially alignable with the breech end 24 of the barrel 12 for placement of ammunition. The ammunition has the projectile 14 and the cartridge case 18 portions; the cartridge case 18 of the ammunition expands during the practice of the invention to substantially seal the hollow bore 26 during the firing of the firearm apparatus.

The movement of the inert mass 20 in relation to the barrel substantially counteracts the propulsion of the projectile portion 14 of the ammunition toward the muzzle end 22 of the barrel 12. The movement of the mass 20 in relation to the barrel 12 exploits the gas pressure which develops in the chamber upon the deflagration of the propellant in the ammunition. The movement of the inert mass 20 expands the chamber defined at least in part in the barrel 12 in its breech end 24. The apparatus has the stop 28 for ceasing or arresting the movement of the inert mass 20, that is, the mass can move until it contacts the stop 28, at which time the relative motion is ended. The stop 28 is placed so that the movement of the mass 20 ceases, and this cessation of movement takes place after the projectile has left the barrel bore. When the mass 20 contacts the stop 28, the cartridge case 18 is ejected from the hollow bore 26. It is seen that the mass 20 has such a weight so that it contacts the stop 28 after the projectile has left the barrel bore.

Figure 4:
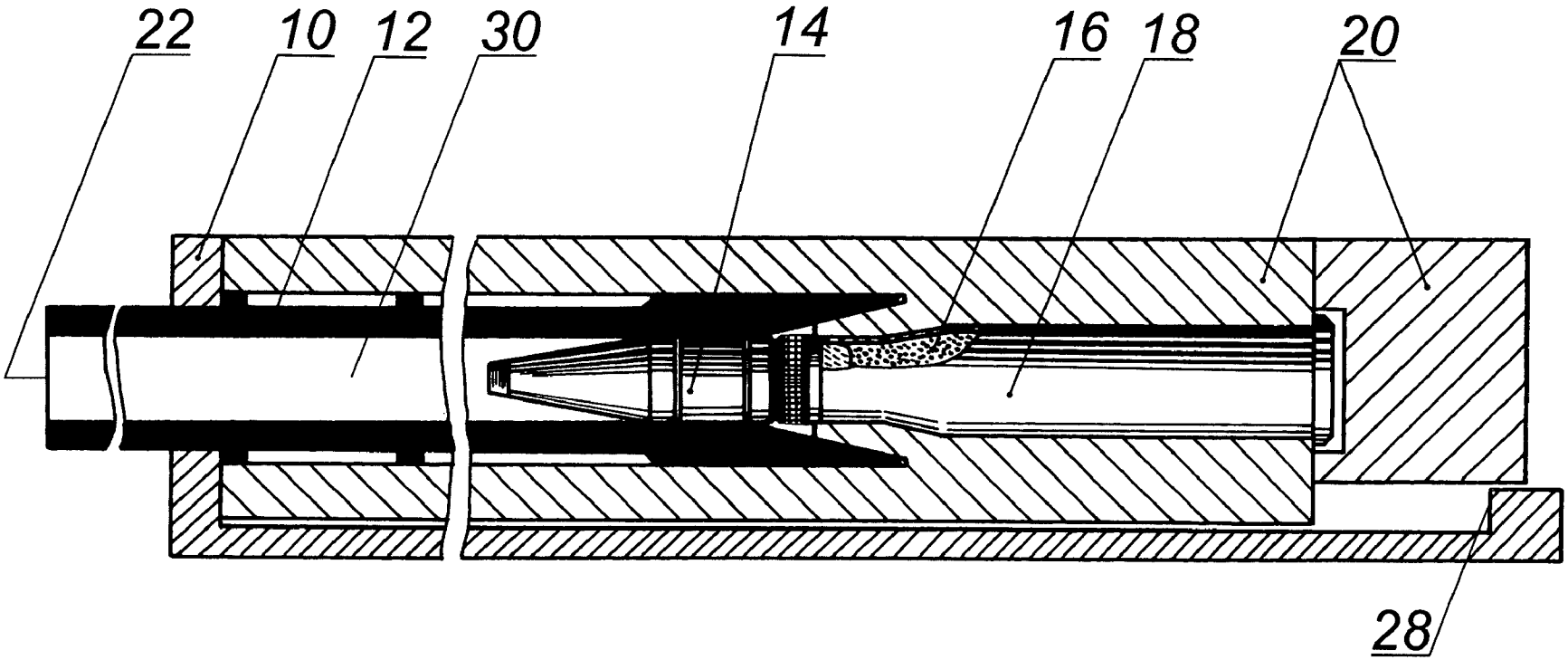
FIG. 4 is a schematic drawing of a partial side view, shown in section, of an automatic firearm before firing a cartridge, according to an additional embodiment of the present invention.

FIG. 4—Additional Embodiment

An additional embodiment is shown in FIG. 4. It has the same parts as the preferred embodiment with some modification of inert mass 20. Inert mass 20 in FIG. 4 consists of two separate members—the frontal member or the main body which is disposed on barrel 12, and the rear member which comes in contact with the main body and is disposed at the head of cartridge case 18 but does not touch the latter. The two members of inert mass 20 are not engaged with each other and both reciprocate along the barrel's longitudinal axis. The range of movement of the main body of inert mass 20 is limited between the frontal wall of frame 10 and stop 28, whereas the rear member can travel beyond stop 28 with subsequent cartridge engagement and loading of the cartridge into the main body of inert mass 20 for the next discharge. The total weight of inert mass 20 in FIG. 4 is the arithmetic sum of the weights of its two members.

Figure 5:
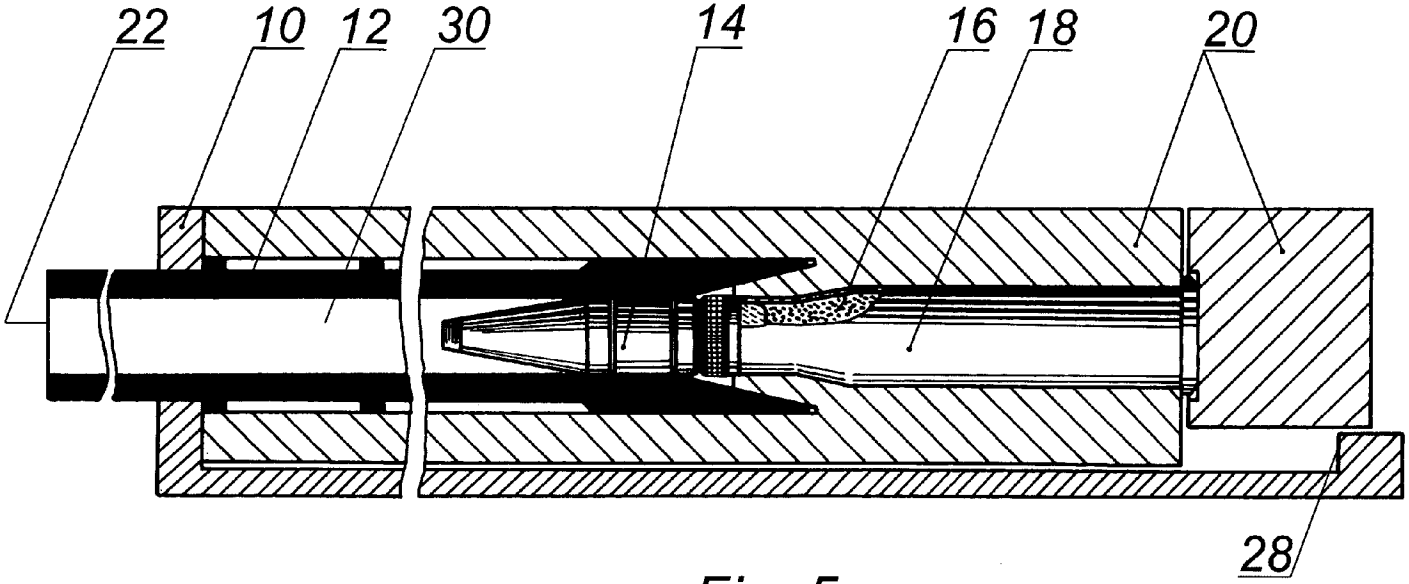
FIG. 5 is a schematic drawing of a partial side view, shown in section, of an automatic firearm before firing a cartridge, according to an alternative embodiment of the present invention.

FIG. 5—Alternative Embodiment

An alternative embodiment is shown in FIG. 5. It differs from the additional embodiment in FIG. 4 by the construction of the rear member of inert mass 20. As seen in FIG. 5, the rear member of inert mass 20 comes in contact with the head of cartridge case 18. The two members of inert mass 20 do not touch each other and both reciprocate along the barrel's longitudinal axis. This arrangement of parts ensures that upon firing, the rear member is moved by cartridge case 18. The rest of this embodiment is similar to the additional embodiment described above.

From the description above, a number of advantages of the new method of firing of firearms in the present invention become evident:

a) The usage of both the action force that propels a projectile and its counterpart—the reaction force—in the process of firing has dramatically improved the accuracy of firing by making negligible the main contributing factor to projectile dispersion—angular barrel displacement prior to the projectile leaving the muzzle.

b) The simplicity of the method will provide the ability to design firearms that are inexpensive, technologically easy to manufacture, highly reliable, and have simple maintenance requirements.

c) Excellent balancing and compactness of the firearm construction will facilitate accurate aiming, shooting, and handling of the firearm.

d) Unique combination of operations performed and their timing during the process of firing will allow using high power ammunition with other advantageous features being unaffected.

e) The unprecedented novelty of this method of firing will initiate the development of many new derived firearm designs.

Operation—FIGS. 1, 2, and 3

FIG. 1 shows the arrangement of parts and the placement of a cartridge in a firearm ready for firing. Ignition of propellant 16 is performed in any possible way known in the art. It can be, for example, electrical ignition, mechanical ignition by a firing pin, or laser-actuated ignition. Rapidly deflagrating propellant 16 produces a large amount of gas which in turn creates very high pressure and causes projectile 14 to move. Projectile 14 enters the rifled portion of barrel 12 and proceeds to move in the barrel bore.

As soon as the expanding gases start acting upon projectile 14 causing it to move, a substantially equal in magnitude and opposite in direction force starts acting upon the bottom of cartridge case 18 (i.e. the inner surface of the head of cartridge case 18). Since the main body of cartridge case 18 gets firmly pressed against the wall of hollow bore 26 of inert mass 20 by the expanding gases, the above-mentioned force carries inert mass 20, along with cartridge case 18, in the direction opposite to the direction of the movement of projectile 14, FIG. 2.

After projectile 14 has left the muzzle, inert mass 20 is brought to a complete or partial stop by an element on its way. As seen in FIG. 3, inert mass 20 is stopped by stop 28—a step-like elevation formed in frame 10. Since gas pressure has dropped to approximately the level of the ambient pressure by now, cartridge case 18 is no longer pressed against the inner wall of inert mass 20. Cartridge case 18 keeps moving in the rearward direction by inertia.

As cartridge case 18 gets completely out of inert mass 20, it hits a projection on its way formed in frame 10 and is discarded, FIG. 3.

The specific values of such parameters of inert mass 20 as its weight, speed of movement, and the distance it covers during firing a cartridge are chosen depending on the concrete type of firearm being designed and ammunition to be used.

Thus the invention includes a method of firing ammunition. The method is understood generally from the foregoing discussion of a suitable apparatus. Ammunition is provided, comprising a projectile 14, which may or may not be mated with a cartridge case 18. There also is provided a firearm having a barrel 12 comprising a barrel bore 30 extending axially between an open breech end 24 and a muzzle end 22. The next step of the method is providing an inert mass 20 featuring a hollow bore 26, the hollow bore being substantially aligned with the breech end 24 of the barrel 12. The user then proceeds to load the ammunition in the firearm so that at least a portion of the cartridge case 18 resides in the hollow bore 26 of the inert mass 20, followed by propelling, with an action force, the projectile 14 toward the muzzle end 22 of the barrel 12, while permitting the cartridge case 18 to substantially seal the hollow bore 26 of the inert mass 20, and then moving the mass 20 and the cartridge case 18 in relation to the barrel 12. Preferably, the step of moving the mass 20 exploits at least a reaction force created by propelling the projectile. Also, the propelling step preferably is the step of burning at least a portion of a propellant within the cartridge case 18, while the sealing step preferably includes expanding the cartridge case 18 within the hollow bore 26 of the mass 20.

The preferred method may also include the step of ejecting the cartridge case 18 from the hollow bore 26 of the mass 20 after the projectile 14 has left the barrel bore 30. "Providing a mass" preferably but not necessarily means at least partially surrounding the barrel 12 with one or more parts of the mass 20. The inert mass is defined as one or more parts of the firearm itself that move during firing. The term "during firing" refers to the time interval that starts at the moment the propellant is ignited and ends at the moment the bullet has left the barrel bore. The moving step includes moving at least a part of the inert mass 20 in a direction substantially opposite the direction of movement of the projectile 14. Also, the moving step may include exploiting the gas pressure developed upon the deflagration of the propellant.

The preferred version of the method includes the step of securing against substantial gas escape via the breech end 24 of the barrel 12, by permitting an object other than a part of the firearm to substantially seal a chamber, which chamber is defined at least in part by the breech end 24 of the barrel 12. This sealing step is accomplished by expanding the object—preferably the cartridge case 18—so that the expanded case seals the chamber. The method preferably includes the step of disposing the object, such as the cartridge case 18, in the inert mass 20, after which the object and the mass 20 are moved in relation to the barrel 12.

Operation of the Additional Embodiment—FIG. 4

The additional embodiment shown in FIG. 4 operates the same way as the preferred embodiment with the addition of the operation of loading the firearm with another cartridge after firing, which is typical for automatic firearms. During firing, the rear member of inert mass 20 is moved by the main body of inert mass 20. After firing a cartridge, a spent cartridge case is extracted and discarded from the firearm as described above, while the rear member of inert mass 20 keeps moving past stop 28. On its way back towards the main body of inert mass 20, the rear member engages another cartridge and moves it into the main body, thus loading the firearm and readying it for the next discharge.

Operation of the Alternative Embodiment—FIG. 5

The operation of the alternative embodiment is similar to the operation of the additional embodiment differing only in the way the rear member of inert mass 20 is moved during firing. When the main body of inert mass 20 moves backwards during firing, cartridge case 18 pushes the rear member of inert mass 20 giving it momentum for backward movement. Cartridge case 18 gets extracted and discarded while the rear member keeps moving and completes the operation of firearm reloading by engaging another cartridge and moving it into the main body of inert mass 20 for the next discharge.

Thus, the reader will see that the new method of firing of the invention provides a way to construct highly reliable, accurate, and well-balanced firearms that can be used by many official powers such as the armed forces, special operations professionals, law enforcement, etc. Furthermore, the inventive method of firing of the invention has the following advantages in that:

- it provides the possibility to design many new derived firearm constructions that operate according to the disclosed method;
- it permits inexpensive manufacturing of such firearms due to their simplicity;
- it provides greater accuracy compared to all existing prior art firearms due to small projectile dispersion;
- it permits building automatic firearms with very high firing rates.

While the above description contains many specificities, these should not be construed as limitations on the scope of the invention, but rather as an exemplification of one preferred, one additional, and one alternative embodiment thereof. Many other variations are possible. For example, automatic operation can easily be realized by feeding another cartridge into the inert mass after each shot thus readying the firearm for the next shot.

There can be many variations of the inert mass. It can be made as a single-unit element or consist of two or more separate members. The inert mass can be made of any conceivable shape or configuration, regardless of the number of members it consists of. As stated above, the members of the inert mass are defined as the parts of the firearm that move during firing. Different members of the inert mass may move in different directions and have any type of movement (e.g., straight line movement, rotation, or other). The rear member of the inert mass also may have variations. For example, it can be made smaller covering only a small portion of the cartridge case head. Some other variations of the inert mass are possible to accommodate a specific placement of one or more of its members with respect to the barrel. For example, with an appropriate choice of the size of the breech portion of the barrel and that of the inert mass member containing the hollow bore, the inert mass member may be disposed inside the breech portion of the barrel. The center of mass of the inert mass can be located anywhere relative to the centerline of the barrel bore. The inert mass will have different weights for various types of firearms and ammunition used. The distance the inert mass travels during firing will also depend on the power of ammunition, type of the firearm, and other firearm-specific parameters.

As was mentioned above, the propellant can be ignited in any way known in the art, such as by striking the primer of the cartridge with sufficient force by a firing pin or hammer, or by an electrical or laser-actuated means, or any other means that will result in the ignition of the propellant.

Thus the scope of the invention should be determined not by the embodiments illustrated, but by the appended claims and their legal equivalents.

INDUSTRIAL APPLICABILITY

The method of firing of firearms disclosed in the present invention has been tested with working models. The test procedures were performed independently by several testing operators without using any firearm immobilizing equipment. The results of the tests are shown below for different types of firearms.

Thus, the invention is further illustrated by the following non-limiting examples.

EXAMPLE 1

Pistols

Firearm and test procedure parameters:

- Weight: ≈1 kg;
- Caliber: 9 mm;
- Ammunition energy: ≈1000 J
- Number of shots performed in the testing series per firearm unit: 90;
- Number of firearm units in the testing series: 2;
- Distance to the target: 25 meters;
- Operator firing position: Standing upright holding a firearm with one hand.

Test results:

Of the 180 combined shots from the 2 test pistols, two of the farthest bullet holes in the target were located 103 mm apart.

Test results for a pistol with an implemented error correction mechanism:

Of 90 shots performed, two of the farthest holes in the target were located 75 mm apart.

EXAMPLE 2

Automatic Sniper Rifles

Firearm and test procedure parameters:

- Weight: 5.2 kg;
- Caliber: 0.30";
- Number of shots performed in the testing series per firearm unit: 90;
- Number of firearm units in the testing series: 2;
- Distance to the target: 300 meters;
- Operator firing position: Prone using a belt to hold the firearm.

Test results:

Of the 180 combined shots from the 2 test rifles, two of the farthest bullet holes in the target were located 78 mm apart.

Test results for a rifle with an implemented error correction mechanism:

Of 90 shots performed, two of the farthest holes in the target were located 71 mm apart.

EXAMPLE 3

23 mm Single-Barrel Automatic Gun

The present invention allowed the implementation of a new type 23 mm automatic gun with the following parameters:

- The automatic reloading cycle begins as early as the projectile has entered the rifled section of the barrel during firing;
- Lower weight of the gun (compared to all existing models);
- Accelerated reloading;
- Rapid high pressure drop in the barrel bore after a projectile has left the muzzle;
- The firing rate of 1920-2000 shots/min (the length of the rifled part of the barrel was 70 calibers or 1610 mm).
- This automatic gun can also be implemented as an anti-aircraft Gatling gun with a plurality of barrels.

Note: Since the method of firing is a primary concern of this patent application, not all mechanisms allowing the above-mentioned features are shown in the accompanying drawings.

The results of the tests conclude that all types of arms that function according to the disclosed method of firing are superior to all existing types of firearm designs.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of firing a firearm comprising the steps of:

providing the firearm comprising a barrel comprising a barrel bore extending between a breech end and a muzzle end;

providing an inert mass comprising a part of the firearm with a hollow bore, the hollow bore being substantially aligned with the breech end of the barrel;

providing ammunition comprising a projectile and a cartridge case, the cartridge case comprising a main body;

loading the ammunition in the firearm so that at least a portion of the main body of the cartridge case resides in the hollow bore;

propelling the projectile toward the muzzle end of the barrel;

substantially sealing the hollow bore with the cartridge case;

moving the cartridge case and at least the part of the inert mass with the hollow bore in relation to the barrel;

wherein the improvement comprises having at least a portion of the main body of the cartridge case disposed in the hollow bore during firing without the presence of any breech locking mechanism or part of the firearm disposed rearward of the cartridge case and arranged to prevent the cartridge case from getting completely out of the hollow bore during firing, whereby the method of firing is performed in a simple and reliable way allowing a simple and lightweight firearm construction.

2. The method of claim 1 wherein the moving step comprises exploiting gas pressure developed upon the deflagration of a propellant.

3. The method of claim 2 wherein the sealing step comprises expanding the cartridge case.

4. The method of claim 3 wherein the moving step comprises moving the cartridge case and at least the part of the inert mass with the hollow bore in relation to the barrel at least until the projectile has left the barrel bore.

5. The method of claim 4 wherein in the step of providing the inert mass, the inert mass comprises two or more parts of the firearm.

6. The method of claim 5 wherein the moving step comprises moving the cartridge case and at least the part of the inert mass with the hollow bore in a direction substantially opposite the direction of movement of the projectile.

7. The method of claim 5 wherein the step of providing the inert mass comprises at least partially surrounding the barrel with at least one part of the inert mass.

8. The method of claim 4 further comprising the step of providing a frame, wherein the barrel is immovably mounted in the frame.

9. A method of firing a firearm comprising the steps of:

providing the firearm comprising a barrel comprising a barrel bore extending between a breech end and a muzzle end;

providing an inert mass comprising a part of the firearm comprising a hollow bore, the hollow bore being substantially aligned with the breech end of the barrel;

providing ammunition comprising a projectile and a cartridge case, the cartridge case comprising a main body;

loading the ammunition in the firearm so that at least a portion of the main body of the cartridge case resides in the hollow bore;

propelling the projectile toward the muzzle end of the barrel;

substantially sealing the hollow bore with the cartridge case;

moving the cartridge case and at least the part of the inert mass comprising the hollow bore in relation to the barrel;

wherein at least a portion of the main body of the cartridge case remains disposed in the part of the inert mass comprising the hollow bore during firing without having any other part of the firearm arranged to prevent the cartridge case from getting completely out of the hollow bore during firing, whereby the method of firing is performed in a simple and reliable way allowing a simple and lightweight firearm construction.

10. The method of claim 9 wherein the moving step comprises exploiting gas pressure developed upon the deflagration of a propellant.

11. The method of claim 10 wherein the sealing step comprises expanding the cartridge case.

12. The method of claim 11 wherein the moving step comprises moving the cartridge case and at least the part of the inert mass comprising the hollow bore in relation to the barrel at least until the projectile has left the barrel bore.

13. The method of claim 12 wherein the moving step comprises moving the cartridge case and at least the part of the inert mass comprising the hollow bore in a direction substantially opposite the direction of movement of the projectile.

14. The method of claim 12 wherein the step of providing the inert mass comprises at least partially surrounding the barrel with at least one part of the inert mass.

15. The method of claim 12 further comprising the step of providing a frame, wherein the barrel is immovably mounted in the frame.

16. A method of firing a firearm comprising the steps of:

providing the firearm comprising a barrel comprising a barrel bore extending between a breech end and a muzzle end;

providing an inert mass comprising a part of the firearm comprising a hollow bore, the hollow bore being substantially aligned with the breech end of the barrel;

providing ammunition comprising a projectile and a cartridge case, the cartridge case comprising a main body;

defining an expandable chamber at least in part by the breech end of the barrel;

loading the ammunition in the firearm so that at least a portion of the main body of the cartridge case resides in the hollow bore;

propelling the projectile toward the muzzle end of the barrel;

substantially sealing the hollow bore with the cartridge case;

moving the cartridge case and at least the part of the inert mass comprising the hollow bore in relation to the barrel;

securing the expandable chamber against any substantial gas escape;

wherein the securing step comprises having at least a portion of the main body of the cartridge case disposed in the part of the inert mass comprising the hollow bore during firing without having any other part of the firearm arranged to prevent the cartridge case from getting completely out of the hollow bore during firing, whereby the method of firing is performed in a simple and reliable way allowing a simple and lightweight firearm construction.

17. The method of claim 16 wherein the moving step comprises exploiting gas pressure developed upon the deflagration of a propellant.

18. The method of claim 17 wherein the sealing step comprises expanding the cartridge case.

19. The method of claim 18 wherein the moving step comprises moving the cartridge case and at least the part of the inert mass comprising the hollow bore in relation to the barrel at least until the projectile has left the barrel bore.

20. The method of claim 19 wherein the moving step comprises moving the cartridge case and at least the part of the inert mass comprising the hollow bore in a direction substantially opposite the direction of movement of the projectile.

21. The method of claim 19 wherein the step of providing the inert mass comprises at least partially surrounding the barrel with at least one part of the inert mass.

22. The method of claim 19 further comprising the step of providing a frame, wherein the barrel is immovably mounted in the frame.

23. In combination:

a firearm comprising a barrel comprising a barrel bore extending between a breech end and a muzzle end;

ammunition comprising a projectile and a cartridge case, said cartridge case comprising a main body;

an inert mass comprising a part of said firearm moveable with respect to said barrel and comprising a hollow bore for placement of said ammunition, said hollow bore being substantially alignable with said breech end of said barrel;

wherein said cartridge case substantially seals said hollow bore during firing of said firearm;

wherein said cartridge case and said part comprising said hollow bore move in relation to said barrel during firing of said firearm; and wherein at least a portion of said main body of said cartridge case is arranged to remain disposed in said hollow bore during firing without having any breech locking mechanism or part of the firearm disposed rearward of the cartridge case and arranged to prevent the cartridge case from getting completely out of the hollow bore during firing.

24. The combination of claim 23 wherein a movement of said cartridge case and said part comprising said hollow bore in relation to said barrel exploits gas pressure developed upon the deflagration of a propellant.

25. The combination of claim 24 wherein said cartridge case substantially seals said hollow bore by expanding in said hollow bore.

26. The combination of claim 25 wherein said cartridge case and said part comprising said hollow bore move in relation to said barrel at least until said projectile has left said barrel bore.

27. The combination of claim 26 wherein said cartridge case and said part comprising said hollow bore move in a direction substantially opposite the direction of movement of said projectile.

28. The combination of claim 26 wherein said inert mass comprises at least two parts of said firearm and at least one of said parts at least partially surrounds said barrel.

29. The combination of claim 26 further comprising a frame, wherein said barrel is immovably mounted in said frame.

* * * * *